US009586720B2

(12) United States Patent
Matsubara

(10) Patent No.: US 9,586,720 B2
(45) Date of Patent: Mar. 7, 2017

(54) PALLET STRUCTURE

(71) Applicant: Sanko Co., Ltd., Mizuho-shi, Gifu (JP)

(72) Inventor: Hiroaki Matsubara, Gifu (JP)

(73) Assignee: Sanko Co., Ltd., Mizuho-shi (JP)

( * ) Notice: Subject to any disclaimer, the term of this patent is extended or adjusted under 35 U.S.C. 154(b) by 0 days.

(21) Appl. No.: 15/170,812

(22) Filed: Jun. 1, 2016

(65) Prior Publication Data

US 2016/0272365 A1 Sep. 22, 2016

Related U.S. Application Data

(63) Continuation of application No. PCT/JP2014/081392, filed on Nov. 27, 2014.

(30) Foreign Application Priority Data

Dec. 25, 2013 (JP) ..... 2013-267344

(51) Int. Cl.
*B65D 19/38* (2006.01)
*B65D 19/00* (2006.01)

(52) U.S. Cl.
CPC ..... *B65D 19/0032* (2013.01); *B65D 19/0012* (2013.01); *B65D 19/385* (2013.01);
(Continued)

(58) Field of Classification Search
CPC ..... B65D 2519/00034; B65D 2519/00273; B65D 2519/00935; B65D 2519/0094; B65D 2519/0096; B65D 2519/00955; B65D 19/06
(Continued)

(56) References Cited

U.S. PATENT DOCUMENTS 3,795,206 A * 3/1974 Utz ..... B65D 19/0016 108/57.28
3,993,168 A * 11/1976 Kubick ..... B65D 19/0034 108/53.1
(Continued)

FOREIGN PATENT DOCUMENTS

JP H02-048541 U 4/1990
JP H08-207932 A 8/1996
(Continued)

OTHER PUBLICATIONS

International Search Report dated from Mar. 3, 2015 from PCT Application No. PCT/JP2014/091392.

*Primary Examiner* — Jose V Chen
(74) *Attorney, Agent, or Firm* — Beyer Law Group LLP

(57) ABSTRACT

A pallet includes columns, an upper deck, and a lower deck. The upper deck links upper ends of the columns such that upper surfaces of the columns and upper deck form an upper deck surface. The lower deck links lower ends of the columns such that lower surfaces of the columns and lower deck form a lower deck surface. Fork insertion structures receive forks of a lift apparatus inserted thereto from four sides of the pallet. Outer circumferential projections are formed along a peripheral edge of the upper deck surface, including an extended portion extending outward from the peripheral edge, and a support portion protruding upward from the extended portion. The support portion has a first height in an insertion-corresponding region, and a second height in a general region, the first height being equal to a thickness of the lower deck, the second height being greater than the first height.

4 Claims, 7 Drawing Sheets

(52) U.S. Cl.
CPC ..... *B65D 2519/00034* (2013.01); *B65D 2519/00069* (2013.01); *B65D 2519/0096* (2013.01); *B65D 2519/00273* (2013.01); *B65D 2519/00288* (2013.01); *B65D 2519/00308* (2013.01); *B65D 2519/00318* (2013.01); *B65D 2519/00333* (2013.01); *B65D 2519/00343* (2013.01); *B65D 2519/00363* (2013.01); *B65D 2519/00398* (2013.01); *B65D 2519/00407* (2013.01); *B65D 2519/00412* (2013.01); *B65D 2519/00562* (2013.01); *B65D 2519/00796* (2013.01); *B65D 2519/00935* (2013.01)

(58) Field of Classification Search
USPC .... 108/57.25, 57.26, 57.28, 53.1, 53.3, 53.5
See application file for complete search history.

(56) References Cited

U.S. PATENT DOCUMENTS 4,226,192 A * 10/1980 Myers ..... B65D 19/0018 108/53.1
5,791,262 A * 8/1998 Knight ..... B65D 19/0012 108/57.25
6,138,582 A * 10/2000 Fujii ..... B65D 19/0012 108/57.25
7,690,315 B2 * 4/2010 Apps ..... B65D 19/004 108/53.3
7,819,068 B2 * 10/2010 Apps ..... B65D 19/004 108/53.1
8,950,342 B2 * 2/2015 Plattner ..... B65D 19/0016 108/56.3
2008/0141912 A1 * 6/2008 Valentinsson ..... B65D 19/0014 108/57.33
2010/0043676 A1 * 2/2010 Apps ..... B65D 19/004 108/53.3
2010/0251941 A1 * 10/2010 Muirhead ..... G06F 21/552 108/57.27
2012/0325125 A1 * 12/2012 Apps ..... B65D 19/0014 108/57.25
2015/0298854 A1 * 10/2015 Linares ..... B65D 19/0018 108/11

FOREIGN PATENT DOCUMENTS

JP 11-139431 5/1999
JP 2002-120834 4/2006

* cited by examiner

PALLET STRUCTURE

CLAIM OF PRIORITY

This application is a Continuation of International Patent Application No. PCT/JP2014/081392, filed on Nov. 27, 2014, which claims priority to Japanese Patent Application No. 2013-267344, filed on Dec. 25, 2013, each of which is hereby incorporated by reference.

BACKGROUND OF THE INVENTION

1. Field of the Invention

The present invention relates to a pallet that is used for transportation of articles or the like.

2. Description of the Related Art

A pallet used for transportation of articles or the like generally includes a plurality of support columns and an upper deck and a lower deck that are respectively arranged to link upper ends and lower ends of the plurality of support columns. The pallet has fork insertion structures provided between the support columns to allow for insertion of forks of a forklift or a handlift.

The pallet may be equipped with a structure for preventing a positional shift or dropping of an article or articles mounted on the pallets. For example, a proposed technique enabling pallets to be stacked (pallet stacking) provides support convexes (support portions) that are protruded upward from regions of a peripheral edge of the upper deck corresponding to the fork insertion structures and forms regions of the lower deck corresponding to the inlets of the fork insertion structures to be recessed toward the inner circumferential side of the lower deck, in order to allow for insertion of the support convexes of the lower pallet (for example, Japanese Patent Application Laid-Open No. H08-207932A).

In the technique described in Japanese Patent Application Laid-Open No. H08-207932A, however, in the pallet stacking state, protrusion of the support convexes of the lower pallet above the upper surface of the lower deck of the upper pallet is likely to interfere with the fork insertion operation into the fork insertion structures of the upper pallet out of the stacked pallets. It is thus desirable that the height of the lower convex is shorter than the height (thickness) of the lower deck.

Accompanied with the recent trend of weight reduction and thickness reduction of the pallet, the thickness of the lower deck is reduced.

BRIEF DESCRIPTION OF THE INVENTION

The inventor has realized that the configuration that matches the height of the support convexes to the thickness of the lower deck does not ensure the sufficient height of the support convexes and is likely to cause an article or articles mounted on the pallet or the upper pallet out of the stacked pallets to be dropped off due to, for example, vibration during transportation.

In order to solve the problems described above and other problems, an object is to provide a pallet of a low height that is configured to prevent an article or articles mounted on the pallet from being dropped off, while avoiding deterioration of the workability of the fork insertion operation into stacked pallets.

The following describes some aspects suitable to achieve the above object and other objects. The functions and the effects characteristic of the respective aspects are also described as appropriate.

In accordance with a first aspect of the present invention, a pallet has an approximately rectangular shape in a plan view. The pallet comprises four corner columns that are provided at four corners of the pallet; middle columns, each being provided in middle between each pair of the corner columns arrayed along a side of the pallets; a center column that is provided at a center of the pallet; an upper deck that is arranged to link upper ends of the corner columns, the middle columns and the center column; and a lower deck that is arranged to link lower ends of the corner columns, the middle columns and the center column. Upper surfaces of the corner columns, the middle columns, the center column and the upper deck define an upper deck surface on which an article or articles are mountable. Lower surfaces of the corner columns, the middle columns, the center column and the lower deck define a lower deck surface that is grounded to a installation surface. The pallet further comprises fork insertion structures that are defined by a lower surface of the upper deck, an upper surface of the lower deck and side faces of the corner columns, the middle columns, and the center columns and are configured such that forks of fork-equipped lift apparatus are insertable into the fork insertion structures from four surfaces constituting an outer circumferential surface of the pallet. The lower deck has a thickness that is less than a thickness of the upper deck. A height of the pallet that is a distance between the upper surface of the upper deck and the lower surface of the lower deck is equal to or less than 100 mm. The pallet further comprises outer circumferential projections that are formed along a peripheral edge of the upper deck surface. The outer circumferential projection includes an extended portion that is formed by extending the upper deck surface toward an outer circumferential side, and a support convex (portion) that is protruded upward from the extended portion. A height of the support convex in an insertion-corresponding region that is a region of the outer circumferential projection located above the fork insertion structure (i.e., a first height) and a thickness of the lower deck are configured to be identical (i.e., equal to each other). A height of the support convex in a general region other than the insertion-corresponding region of the outer circumferential projection is greater than the height of the support convex in the insertion-corresponding region.

According to the first aspect, the height of the support convex in the insertion-corresponding region that is the region of the outer circumferential projection located above the fork insertion structure and the thickness of the lower deck are configured to be an identical length. Accordingly, in the case where the pallets are stacked vertically (pallet stacking), the height of the upper end of the support convex in the insertion-corresponding region of the lower pallet is equal to the height of the upper surface of the lower deck of the upper pallet. In the state that the pallets are stacked, this configuration prevents the inlet (more specifically, its vertical width) of the fork insertion structure in the upper pallet from being narrowed by the outer circumferential projection (i.e., the support convex in the insertion-corresponding region) of the lower pallet when forks are inserted into the fork insertion structures of the upper pallet. As a result, this configuration can improve the workability, for example, when the stacked pallets are sequentially lifted down from the top by using the fork-equipped lift apparatus.

In the case of stacking the pallets by using the fork-equipped lift apparatus, after the upper pallet is placed on the lower pallet, forks are displaced downward to release the support of the lower surface of the upper deck by the forks, for the purpose of drawing the forks out of the fork insertion structures. This configuration prevents the fork from coming into contact with the outer circumferential projection (i.e., the support convex in the insertion-corresponding region) of the lower pallet and damaging the outer circumferential projection in the course of displacing the forks downward.

The outer circumferential projection is also provided in the region (general region) other than the region corresponding to the fork insertion structure. The height of the support convex in the general region is greater than the height of the support convex in the insertion-corresponding region. Even when the height of the support convex in the insertion-corresponding region is reduced not to interfere with the fork insertion operation, this configuration ensures the sufficient height of the support convex in the general region. This avoids possible adverse effects on the fork insertion operation due to providing the outer circumferential projection. Providing the outer circumferential projection more effectively prevents an article or articles mounted on the upper deck surface from being dropped off and prevents the upper pallet from being dropped off. Such function and effect are especially remarkable in the configuration that the height (thickness) of the pallet is equal to or less than 100 mm and the thickness of the lower deck is accordingly to be reduced like the configuration of this aspect.

Additionally, this configuration enhances the rigidity of the outer circumferential projection or more specifically the rigidity of the support convex, compared with a configuration that leaves only the support convex in the general region of the outer circumferential projection but omits the support convex in the insertion-corresponding region. This configuration also enhances the rigidity of and suppresses deformation of the upper deck (the upper edge of the inlet of the fork insertion structure). The expression "identical length" herein includes "substantially identical length" by taking into account the manufacturing error and the like.

In accordance with a second aspect of the present invention, the pallet described in the first aspect may further comprise reinforcement ribs that are formed on an outer surface side of the support convex. With regard to rib pitches of a plurality of vertical ribs that are extended vertically among the reinforcement ribs formed corresponding to the insertion-corresponding region, a side rib pitch in respective side parts of the insertion-corresponding region connecting with adjacent general regions may be narrower than a center rib pitch in a center part of the insertion-corresponding region.

The configuration of according to the second aspect enhances the rigidity of the linkage regions of the upper deck with the corner columns and the middle columns (respective ends of the upper edges of the inlets of the fork insertion structures). These linkage regions are more likely to be deformed by a downward load or by a torsional force applied to the pallet, compared with, for example, the corner columns and the middle columns. Enhancing the rigidity of the linkage regions effectively suppresses deformation of the upper deck and thereby deformation of the entire pallet.

In accordance with a third aspect, the reinforcement ribs in the pallet described in the second aspect may include lateral ribs extended in a direction crossing the vertical ribs and may be configured in a grid pattern.

The configuration according to the third aspect suppresses side toppling deformation of the respective vertical ribs and enhances the linkage of the vertical ribs in the lateral direction. This accordingly suppresses vertically-shifting deformation of the vertical ribs laterally adjacent to each other and distributes a downward load or a load from the inner circumferential side of the pallet. Especially the configuration of the lateral ribs that are continuously extended from the insertion-corresponding region to the general region enhances such function and effect. Accordingly this configuration more effectively suppresses deformation such as deflection of the upper edge of the inlet of the fork insertion structure and damage of the support convex.

DETAILED DESCRIPTION OF EMBODIMENTS OF THE INVENTION

Figure 1:
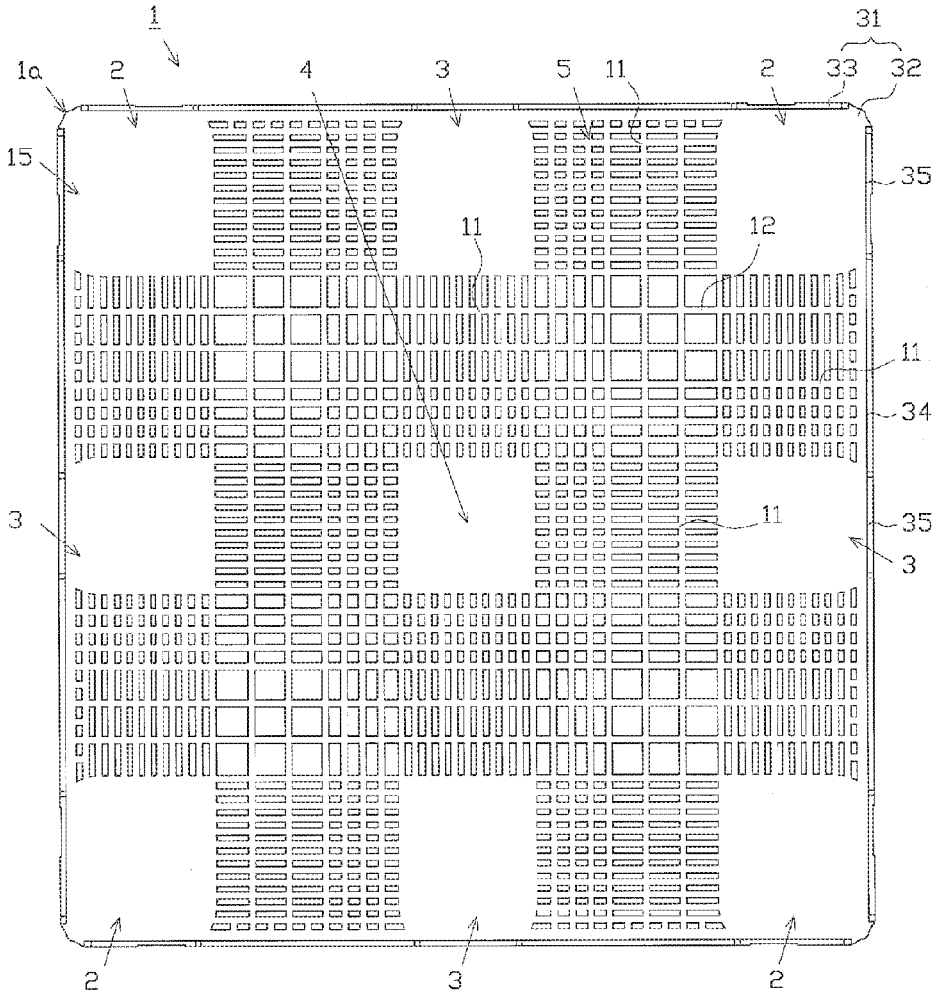
FIG. 1 is a diagram illustrating a plan view of a pallet.
Figure 2:
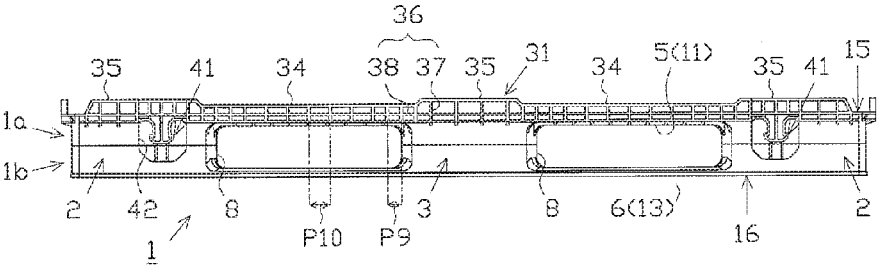
FIG. 2 is a diagram illustrating a side view of the pallet.
Figure 3:
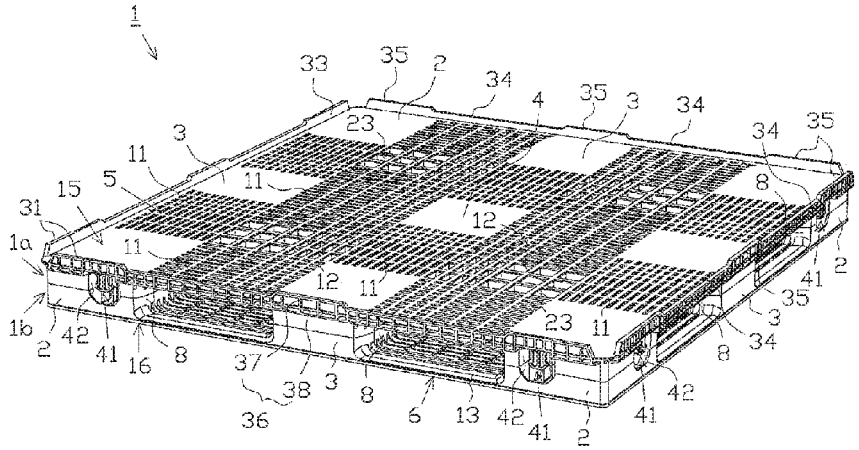
FIG. 3 is a diagram illustrating a perspective view of the pallet.

The following describes one embodiment with reference to drawings. As shown in FIGS. 1 to 3, a pallet 1 is in an approximately rectangular shape in the plan view. The pallet 1 includes four corner columns 2 provided at four corners of the pallet 1, middle columns 3 provided in the middle of the respective pairs of corner columns 2 arrayed along the respective sides of the pallet 1, a center column 4 provided on a center of the pallet 1, an upper deck 5 configured to link the respective upper ends of the corner columns 2, the middle columns 3 and the center column 4, and a lower deck 6 configured to link the respective lower ends of the corner columns 2, the middle columns 3 and the center column 4. Additionally, fork insertion structures 8 are formed between the respective corner columns 2 and the middle columns 3 to allow for insertion of forks 9 (shown in FIG. 8) of a handlift or a forklift as the fork-equipped lift apparatus. According to this embodiment, the pallet 1 is configured as a four-direction insertion-type pallet that allows forks to be inserted from four side faces defining the outer circumferential surface of the pallet 1.

The upper deck 5 includes upper linkage bars 11 that are configured to linearly link the respective upper ends of the respective pairs among the corner columns 2, the middle columns 3 and the center column 4 arrayed parallel to the respective sides of the pallet 1, and upper auxiliary bars 12 that are configured to link the upper linkage bars 11 on the four sides and cover the areas surrounded by the upper linkage bars 11. As shown in, for example, FIG. 8, the lower deck 6 includes lower linkage bars 13 that are configured to linearly link the respective lower ends of the respective pairs among the corner columns 2, the middle columns 3 and the center column 4 arrayed along the longitudinal direction or the short-side direction of the pallet 1. The areas surrounded by the lower linkage bars 13 are, however, opened as caster openings 14 to ground casters provided on a fork end of the handlift.

According to this embodiment, upper surfaces of the corner columns 2, the middle columns 3, the center column 4 and the upper deck 5 define an "upper deck surface 15" on which an article or articles are mountable. Lower surfaces of the corner columns 2, the middle columns 3, the center column 4 and the lower deck 6 define a "lower deck surface 16" that is grounded to a installation surface such as a floor surface.

According to this embodiment, the height (thickness) of the pallet 1 that denotes the distance between the upper deck surface 15 and the lower deck surface 16 is 90 mm. The height of the fork insertion structures 8 is 60 mm. Additionally, the thickness of the upper deck 5 is made greater than the thickness of the lower deck 6, so as to ensure the strength of the upper deck 5 on which an article or articles are mounted and which are lifted up by the forks of the handlift. According to this embodiment, the thickness of the upper deck 5 is 17.5 mm, and the thickness of the lower deck 6 is 12.5 mm.

The pallet 1 of this embodiment consists of an upper configuration part 1*a* and a lower configuration part 1*b*. The upper configuration part 1*a* includes upper portions of the corner columns 2, the middle columns 3 and the center column 4 and the upper deck 5. The lower configuration part 1*b* includes lower portions of the corner columns 2, the middle columns 3 and the center column 4 and the lower deck 6. The lower ends of the corner columns 2, the middle columns 3 and the center column 4 in the upper configuration part 1*a* are thermally welded to the upper ends of the corner columns 2, the middle columns 3 and the center column 4 in the lower configuration part 1*b*, so that the upper configuration part 1*a* and the lower configuration part 1*b* are integrated to form the pallet 1 of this embodiment. According to this embodiment, both the upper configuration part 1*a* and the lower configuration part 1*b* are made of polypropylene.

Figure 4:
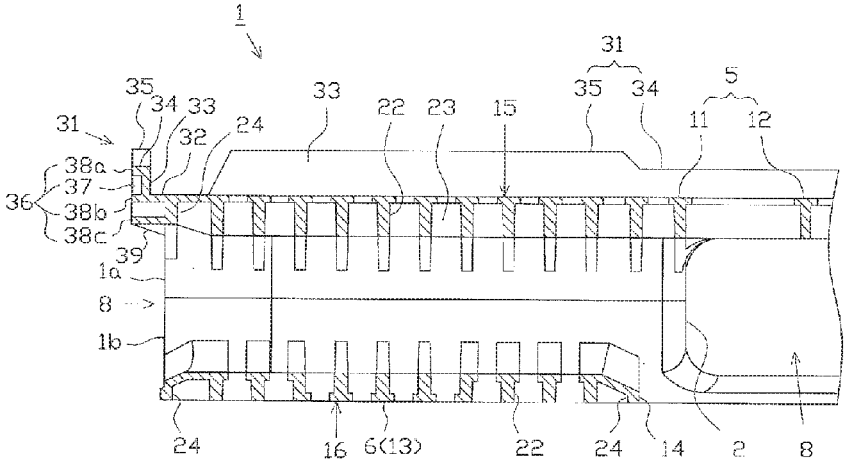
FIG. 4 is a diagram illustrating a sectional view of the pallet.
Figure 5:
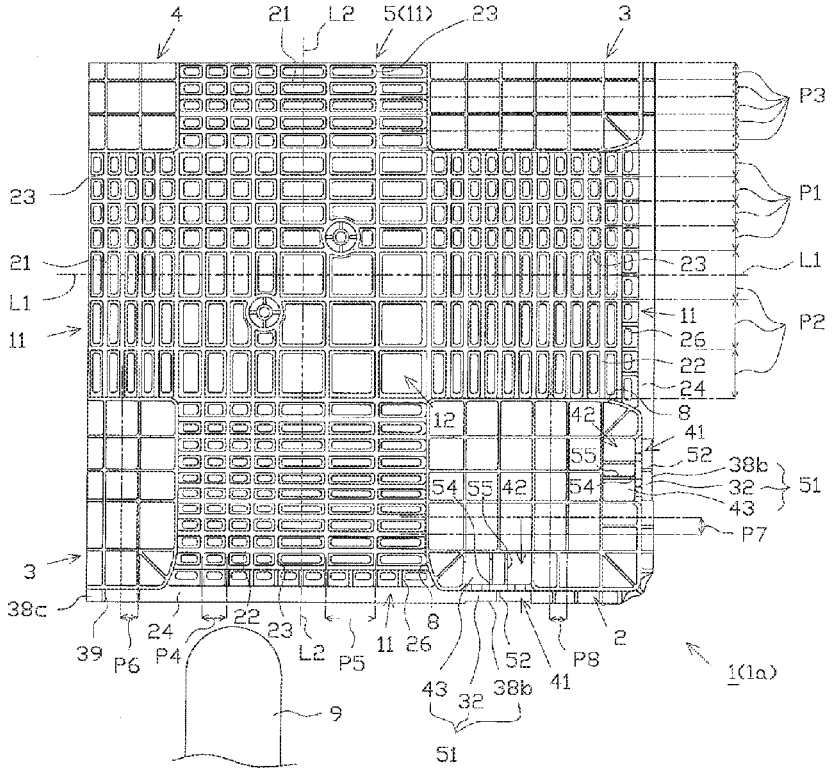
FIG. 5 is a diagram illustrating a bottom view of an upper configuration part.

As shown in FIG. 5, according to this embodiment, a plurality of middle linkage ribs 21 are provided on the lower surface side of the upper linkage bars 11 arranged to link the upper ends of the middle columns 3 and the center column 4, to be protruded downward from the upper linkage bars 11 and are extended approximately parallel to the respective sides of the upper deck surface 15 to link the middle columns 3 and the center column 4. A plurality of side linkage ribs 22 are provided on the lower surface side of the upper linkage bars 11 arranged to link the upper ends of the middle columns 3 and the corner columns 2, to be protruded downward from the upper linkage bars 11 and are extended approximately parallel to the respective sides of the upper deck surface 15 to link the middle columns 3 and the corner columns 2 (as shown in, for example, FIG. 4 and FIG. 8).

Additionally, according to this embodiment, a plurality of full-length ribs 23 are provided on the lower surface side of the upper deck 5 to be extended continuously from one side to the other side of the upper deck 5 in a direction perpendicular to the middle linkage ribs 21 and the side linkage ribs 22. More specifically, the full-length ribs 23 are provided over the full length of a region where the upper deck 5 is continuously provided from one side to the other side of the upper deck surface 15, to be extended through three upper linkage bars 11 and two upper auxiliary bars 12 (as shown in, for example, FIG. 3 and FIG. 8). The fork insertion structures 8 are configured to allow for insertion of forks below a plurality of the upper linkage bars 11 and the upper auxiliary bars 12. The region where the upper deck 5 is continuously provided from one side to the other side of the upper deck surface 15 is equivalent to the region that defines an upper edge of the fork insertion structure 8. In other words, the full-length ribs 23 are extended along the longitudinal direction of the fork insertion structures 8 or the insertion directions of forks into the fork insertion structures 8.

As shown in, for example, FIG. 5, the middle linkage ribs 21 or the side linkage ribs 22 and the full-length ribs 23 provided as described above to be arranged perpendicular to the middle linkage ribs 21 or the side linkage ribs 22 form a grid pattern of ribs on the lower surface side of the upper linkage bars 11. Additionally, some of the full-length ribs 23 are extended along a predetermined side of the pallet 1, and other of the full-length ribs 23 are extended along a side perpendicular to the predetermined side. The full-length ribs 23 are accordingly arranged in a grid pattern on the lower surface side of the upper auxiliary bars 12. The pallet 1 of this embodiment is in an approximately square shape in the plan view, but the width of the pallet 1 in the top-bottom direction on the sheet surface of FIG. 1 is slightly longer. For convenience of explanation, in the description below, the top-bottom of the pallet 1 on the sheet surface of FIG. 1 is referred to as the longitudinal direction of the pallet 1, and the left-right direction of the pallet 1 on the sheet surface of FIG. 1 is referred to as the short-side direction of the pallet 1.

As shown in FIG. 5, according to this embodiment, among the plurality of full-length ribs 23 extended along the longitudinal direction of the pallet 1 (left-side direction in FIG. 5) and arrayed in the short-side direction of the pallet 1, the pitch of the full-length ribs 23 on a center side in the width of the pallet 1 in the short-side direction (inner rib pitch P1) is made narrower than the pitch of the full-length ribs 23 on an edge side in the width of the pallet 1 in the short-side direction (outer rib pitch P2).

More specifically, according to this embodiment, the inner rib pitch P1 is a rib pitch of the full-length ribs 23 located on a center side in the width of the pallet 1 in the short-side direction relative to a middle part L1 in the width direction of (the inlet of) the fork insertion structure 8 having the upper edge defined by the region of the upper deck 5 where the full-length ribs 23 are formed, among the full-length ribs 23 extended in the longitudinal direction of the pallet 1.

Additionally, a middle linkage rib pitch P3 of a plurality of the middle linkage ribs 21 arranged to link the middle column 3 and the center column 4 in the longitudinal direction of the pallet 1 (arrayed in the short-side direction of the pallet 1) is made narrower than the inner rib pitch P1.

According to this embodiment, a rib pitch of a plurality of the full-length ribs 23 extended along the short-side direction of the pallet 1 and arrayed in the longitudinal direction of the pallet 1 is made equal to the rib pitch of the full-length ribs 23 extended along the longitudinal direction of the pallet 1. An inner rib pitch P4 on a center side in the width of the pallet 1 in the longitudinal direction is made narrower than an outer rib pitch P5 on an edge side in the width of the pallet 1 in the longitudinal direction.

More specifically, according to this embodiment, the inner rib pitch P4 is a rib pitch of the full-length ribs 23 located on a center side in the width of the pallet 1 in the longitudinal direction relative to a middle part L2 in the width direction of (the inlet of) the fork insertion structure 8 having the upper edge defined by the region of the upper deck 5 where the full-length ribs 23 are formed, among the full-length ribs 23 extended in the short-side direction of the pallet 1.

Additionally, a middle linkage rib pitch P6 of a plurality of the middle linkage ribs 21 arranged to link the middle column 3 and the center column 4 in the short-side direction of the pallet 1 (extended along the short-side direction of the pallet 1 and arrayed in the longitudinal direction of the pallet 1) is equal to the middle linkage rib pitch P3 of the middle linkage ribs 21 extended along the longitudinal direction of the pallet 1 and arrayed in the short-side direction of the pallet 1 and is made narrower than the inner rib pitch P4.

According to this embodiment, a side linkage rib pitch P7 of a plurality of the side linkage ribs 22 extended along the longitudinal direction of the pallet 1 and arrayed in the short-side direction of the pallet 1 to link the middle column 3 and the corner column 2 in the longitudinal direction of the pallet 1 is made equal to the middle linkage rib pitch P3 of the middle linkage ribs 21. Additionally, a side linkage rib pitch P8 of a plurality of the side linkage ribs 22 extended along the short-side direction of the pallet 1 and arrayed in the longitudinal direction of the pallet 1 to link the middle column 3 and the corner column 2 in the short-side direction of the pallet 1 is made equal to the middle linkage rib pitch P6 of the middle linkage ribs 21.

The wall thickness of the middle linkage ribs 21 is made larger than the wall thickness of the full-length ribs 23. According to this embodiment, the wall thickness of the side linkage ribs 22 is also made larger than the wall thickness of the full-length ribs 23 (equal to the wall thickness of the middle linkage ribs 21).

Figure 8:
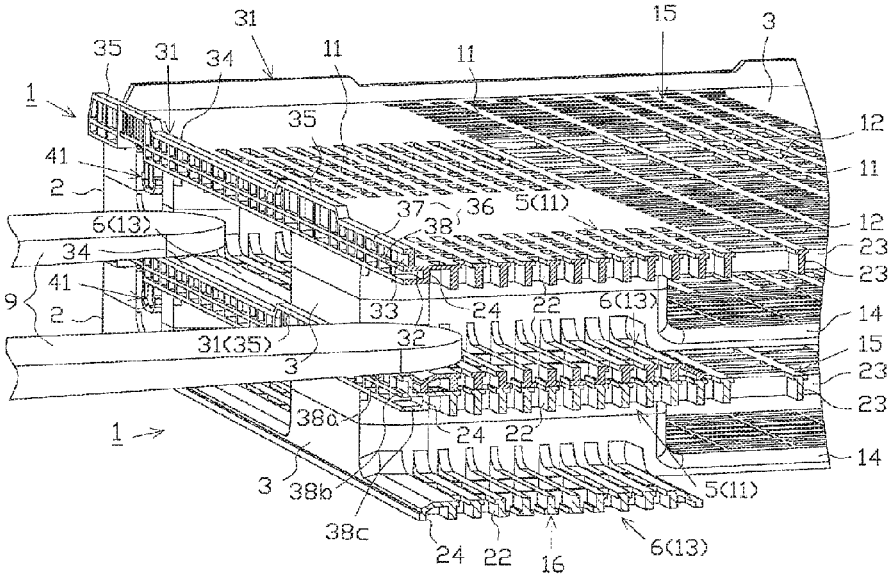
FIG. 8 is a diagram illustrating a perspective view including a cross section of the stacked pallets.

Additionally, as shown in FIG. 4 and FIG. 8, among the side linkage ribs 22, edge linkage ribs 24 located on the outermost circumferential side of the pallet 1 to define the inlet of the fork insertion structure 8 are configured to have a shorter projection length from the upper deck 5, compared with the other side linkage ribs 22, in order to extend the vertical width of the inlet of the fork insertion structure 8. As shown in FIG. 5, in order to enhance the rigidity of the edge linkage ribs 24, auxiliary ribs 26 are further provided at the positions in the middle of the full-length ribs 23 arranged at the outer rib pitches P2 and P5 to link the edge linkage ribs 24 and the adjacent side linkage ribs 22 adjoining to the edge linkage ribs 24.

The lower linkage bars 13 of the lower deck 6 have a similar configuration to the configuration of the upper linkage bars 11 of the upper deck 5. With regard to the lower linkage bars 13, among a plurality of side linkage ribs 22 and a plurality of middle linkage ribs 21 formed on the lower surface side of the lower linkage bars 13, the side linkage ribs 22 and middle linkage ribs 21 located closest to the caster opening 14 (edge linkage ribs 24) are configured to have a lower height from the lower deck surface 16, compared with the other side linkage ribs 22 and middle linkage ribs 21. The upper edge of the edge linkage rib 24 is linked with the upper edge of the adjacent side linkage rib 22 or the adjacent middle linkage rib 21 adjoining to the edge linkage rib 24 by a wall portion. This configuration causes the casters of the handlift to readily ride on the lower linkage bars 13 and enhances the strength of the edges of the lower linkage bars 13. With regard to the lower linkage bars 13, ribs extended perpendicular to the plurality of side linkage ribs 22 and the plurality of middle linkage ribs 21 have a fixed pitch (equal to P2 and P5).

As shown in, for example, FIGS. 2 to 4 and FIG. 8, according to this embodiment, outer circumferential projections 31 formed along the peripheral edge of the upper deck surface 15. The outer circumferential projection 31 includes an extended portion 32 formed by extending the upper deck surface 15 toward the outer circumferential side and a support convex 33 protruded upward from the extended portion 32.

Figure 6:
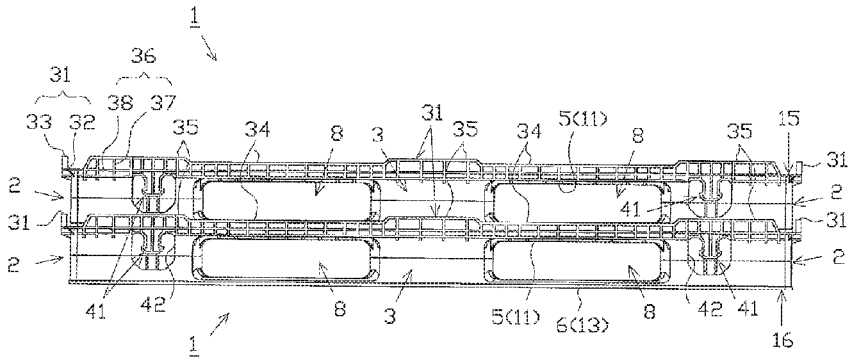
FIG. 6 is a diagram illustrating a side view of stacked pallets.
Figure 7:
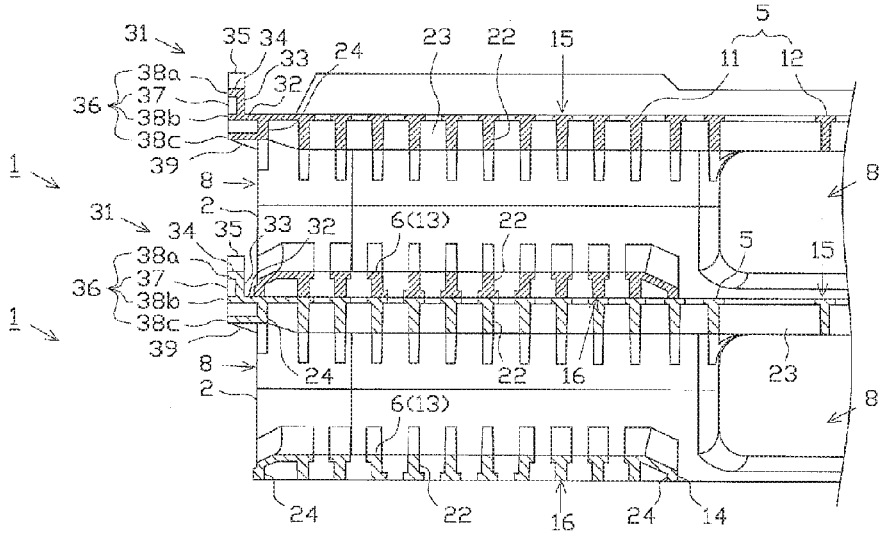
FIG. 7 is a diagram illustrating a sectional view of the stacked pallets.

According to this embodiment, the height of the support convex 33 in an insertion-corresponding region 34 that is a region of the outer circumferential projection 31 located above the fork insertion structure 8 is made equal to the thickness of the lower deck 6. Accordingly, as shown in FIGS. 6 to 8, in the state that the pallets 1 are stacked vertically (pallet stacking state), the upper edges of the support convexes 33 in the insertion-corresponding regions 34 of the outer circumferential projections 31 on the lower pallet 1 is arranged at substantially the same height as the height of the upper surface of the lower deck 6 of the upper pallet 1.

Additionally, as shown in, for example, FIG. 2, according to this embodiment, the height of the support convex 33 in a general region 35 other than the insertion-corresponding region 34 of the outer circumferential projection 31 is made greater than the height of the support convex 33 in the insertion-corresponding region 34. According to this embodiment, the height of the support convex 33 in the insertion-corresponding region 34 is 12.5 mm that is equal to the thickness of the lower deck 6, and the height of the support convex 33 in the general region 35 is 20 mm. The support convex 33 is omitted in regions of the outer circumferential projections 31 corresponding to the corners of the upper deck surface 15. The support convexes 33 in the general regions 35 are formed on the respective sides of the support convex 33 in the insertion-corresponding region 34. The heights of the respective sides of the support convex 33 in the general region 35 are gradually changed to the heights in adjacent regions, while the height of the support convex 33 in the insertion-corresponding region 34 is fixed.

As shown in, for example, FIGS. 7 to 9, reinforcement ribs are formed on the outer surface side of the support convexes 33 (hereinafter referred to as "projection reinforcement ribs 36"). The projection reinforcement ribs 36 include a plurality of vertical ribs 37 extended in the vertical direction and lateral ribs extended approximately perpendicular to the vertical ribs 37 and are arranged in a grid pattern. More specifically, the lateral ribs 38 include upper lateral ribs 38*a* protruded outward from the upper edges of the support convexes 33 of the outer circumferential projections 31, middle lateral ribs 38*b* formed to extend the extended portions 32 of the outer circumferential projections 31 outward, and lower lateral ribs 38*c* protruded outward from the lower edges of the edge linkage ribs 24 located on the outermost circumferential side of the pallet 1 among the side linkage ribs 22. The vertical ribs 37 are extended approximately in the vertical direction from the upper lateral ribs 38*a* to the lower lateral ribs 38*c* (to the middle lateral ribs 38*b* in locations without the lower lateral ribs 38*c*).

The outer surfaces of the projection reinforcement ribs 36 defined by the edges of the vertical ribs 37 and the lateral ribs 38 are basically flush. According to this embodiment, the outer surfaces of the projection reinforcement ribs 36 are located on the outermost circumferential side of the pallet 1. Additionally, as shown in, for example, FIG. 9, support ribs 39 in a triangular plate-like shape are provided on the lower surface side of the projection reinforcement ribs 36 to link lower surfaces of the lower lateral ribs 38*c* and an outer surface of the corner column 2.

Additionally, as shown in FIG. 2, according to this embodiment, among a plurality of the vertical ribs 37 formed corresponding to the insertion-corresponding region 34 of the outer circumferential projection 31, the vertical ribs 37 in respective side parts of the insertion-corresponding region 34 connecting with adjacent general regions 35 are configured to have a narrower pitch (side rib pitch P9) than a pitch of the vertical ribs 37 in a center part of the insertion-corresponding region 34 (center rib pitch P10). More specifically, in the front view of the inlet of the fork insertion structure 8, the side rib pitch P9 is a rib pitch of the vertical ribs 37 in regions crossing over the boundaries between the middle columns 3 and the corner columns 2 and the fork insertion structure 8.

Figure 9:
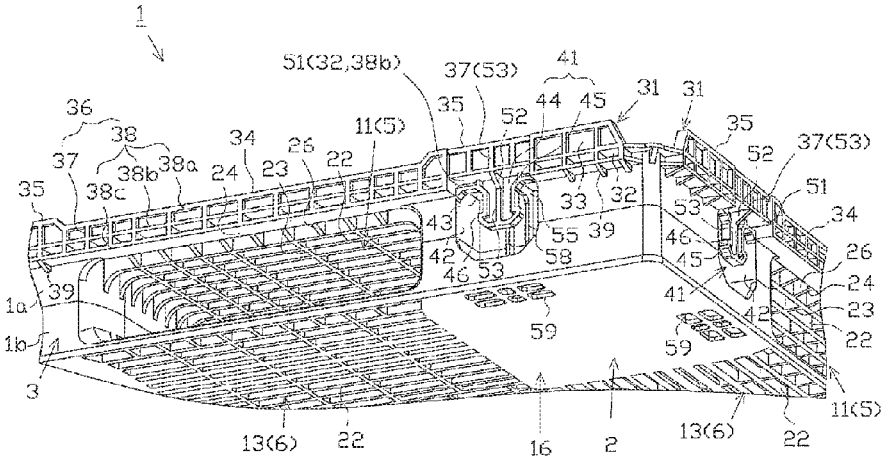
FIG. 9 is a diagram illustrating a perspective view of the pallet, viewed upward.

As shown in, for example, FIG. 3 and FIG. 9, locking elements 41 are provided on the outer circumferential surface side of the pallet 1 to lock a rope for holding an article or articles mounted on the pallet 1. More specifically, a locking opening recess 42 is formed in each of two side faces (outer surfaces) of each corner column 2 defining the outer circumferential surface of the pallet 1 to be open to the outer circumferential side of the pallet 1. The upper edge of the locking opening recess 42 is defined by a lower surface of an upper wall portion 43 of the corner column 2, which has an upper surface defining the upper deck surface 15. According to this embodiment, the locking element 41 is protruded downward from a lower surface of the upper wall portion 43.

As shown in, for example, FIG. 9, the locking element 41 includes a plate-like locking piece 44 that is extended downward from the lower surface of the upper wall portion 43 approximately parallel to the side face of the corner column 2 which the corresponding locking opening recess 42 is open to, and an outer edge reinforcement rib 45 extended outward from the periphery of the locking piece 44. A hook portion 46 is provided on an end (lower portion) of the locking piece 44 to be protruded sideward from the left and right sides of the lower portion. The locking piece 44 has a region in the vicinity of its upper end connecting with the upper wall portion 43 to be extended sideward both on the left side and on the right side to the inner side faces of the locking opening recess 42 and to be linked with the inner side faces. The outer edge reinforcement rib 45 is also formed on a lower edge of the region of the locking piece 44 extended sideward both on the left side and on the right side, as well as on a boundary with the region of the locking piece 44 extended sideward both on the left side and on the right side.

Figure 10:
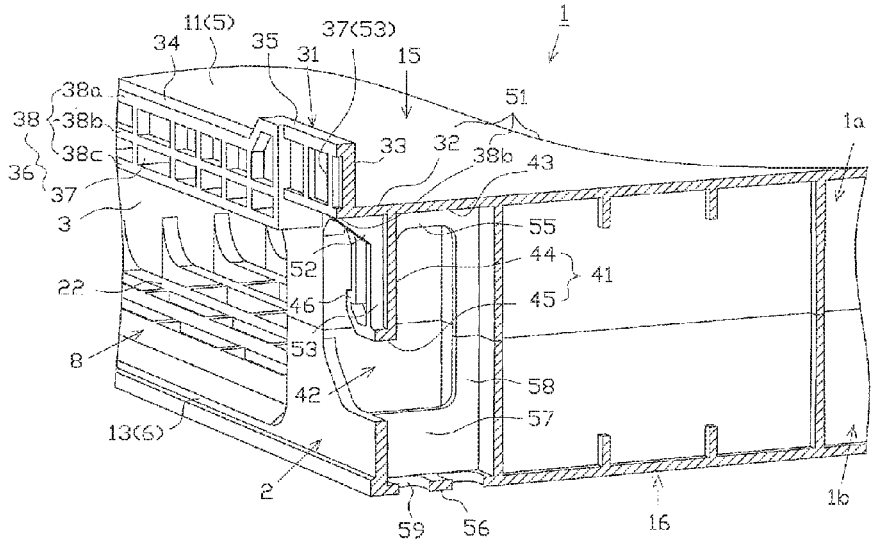
FIG. 10 is a diagram illustrating a perspective view including a cross section of the pallet.

Additionally, as shown in, for example, FIG. 9 and FIG. 10, the locking piece 44 is located on the inner circumferential side of the pallet 1 away from the corresponding side face (outer surface) of the corner column 2 by a predetermined distance. An edge of the outer edge reinforcement rib 45 or more specifically an end of the outer edge reinforcement rib 45 on the outer circumferential side of the pallet 1 is flush with the side face (outer surface) of the corner column 2. The locking element 41 is formed integrally with the upper configuration part 1*a*, and the lower end of the locking element 41 is located above the lower end of a region of the corner column 2 defined by the upper configuration part 1*a*.

The lower lateral rib 38*c* is omitted in a region of the projection reinforcement rib 36 corresponding to the locking opening recess 42, and the extended portion 32 of the outer circumferential projection 31 formed to be extended outward from the upper wall portion 43 of the corner column 2 and the middle lateral rib 38*b* extended outward from the extended portion 32 are exposed downward in this region. In the description below, the upper wall portion 43 from which the locking piece 44 is extended, the extended portion 32 of the outer circumferential projection 31 formed to be extended outward from the upper wall portion 43 and the middle lateral rib 38*b* extended outward from the extended portion 32 are collectively referred to as "mounting wall 51". The outward projection length of the projection reinforcement rib 36 in the region of the projection reinforcement rib 36 corresponding to the locking opening recess 42 is made shorter than the outward projection length in the other regions. Additionally, regions where the outward projection length of the projection reinforcement rib 36 is not shortened (with no omission of the lower lateral rib 38*c*) are provided on both sides of the region where the outward projection length of the projection reinforcement rib 36 is shortened.

A reinforcement rib (hereinafter referred to as "locking reinforcement rib 52") is provided on the corner column 2 of the embodiment to link a surface of the locking piece 44 on the outer circumferential side of the pallet 1 with a lower surface of the mounting wall 51. The locking reinforcement rib 52 is provided at a position corresponding to the center position in the width direction of the locking element 41 (locking piece 44). The locking reinforcement rib 52 is extended to an edge of the lower surface of the mounting wall 51 on the outer circumferential side of the pallet 1 (end of the middle lateral rib 38*b*). In other words, an end of the locking reinforcement rib 52 on the outer circumferential side of the pallet 1 is extended to an outer surface of the projection reinforcement rib 36. According to this embodiment, however, the outward projection length of the projection reinforcement rib 36 is made shorter in the region of the projection reinforcement rib 36 corresponding to the locking opening recess 42 than the outward projection length in the other regions as described above.

Figure 12:
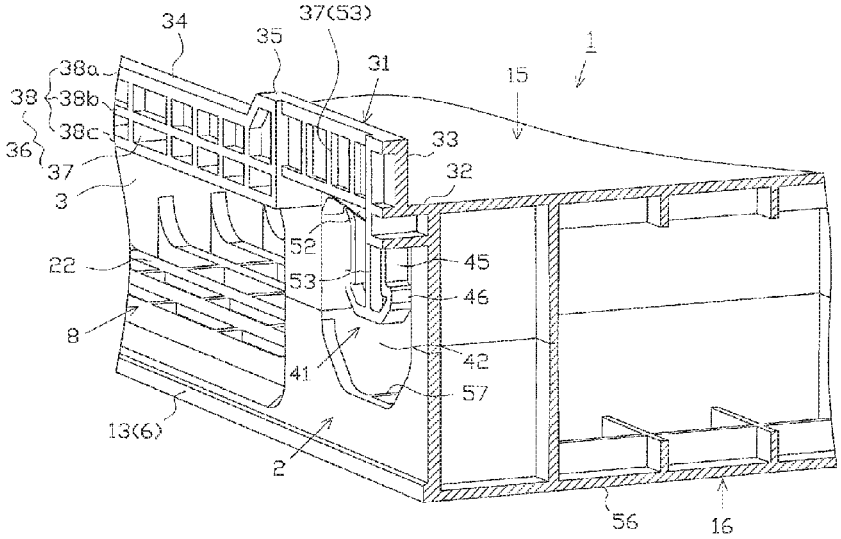
FIG. 12 is a diagram illustrating a perspective view including a cross section of the pallet.

Accordingly the end of the locking reinforcement rib 52 on the outer circumferential side of the pallet 1 is located on the inner circumferential side of the outermost circumferential side region of the pallet 1 (as shown in FIG. 12).

The locking reinforcement rib 52 is provided in an upper range of the locking element 41 (locking piece 44) (range of ⅕ to not greater than ⅓ of the total height of the locking element 41 from the connecting portion with the mounting wall 51). Additionally, a side of the locking reinforcement rib 52 on the outer circumferential side of the pallet 1 is extended to be inclined upward toward the outer circumferential wide of the pallet 1, and the locking reinforcement rib 52 is formed in an approximately triangular plate-like shape.

An extended reinforcement rib 53 is formed to be extended downward from a lower portion of the locking reinforcement rib 52. The extended reinforcement rib 53 is extended to abut against the outer edge reinforcement rib 45 formed along a lower side of the locking element 41 and is linked with the outer edge reinforcement rib 45. The projection length of the extended reinforcement rib 53 from the locking piece 44 is equal to the projection length of the outer edge reinforcement rib 45 and is substantially flush with the outer surface of the corner column 2.

In the front view of each locking piece 41, the position at which the locking reinforcement rib 52 is formed in the left-right direction is matched with the position of one of the vertical ribs 37 of the projection reinforcement ribs 36. Extending the end of the locking reinforcement rib 52 on the outer circumferential side of the pallet 1 to the edge of the mounting wall 51 on the outer circumferential side of the pallet 1 as described above provides such a positional relationship that the vertical rib 37 vertically connecting with the locking reinforcement rib 52 looks like to be extended upward from the end of the locking reinforcement rib 52 on the outer circumferential side of the pallet 1. Accordingly, like the extended reinforcement rib 53 extended below the locking reinforcement rib 52, the vertical rib 37 cooperates with the locking reinforcement rib 52 and provides, for example, the effect of preventing deformation of the locking element 41.

Figure 11:
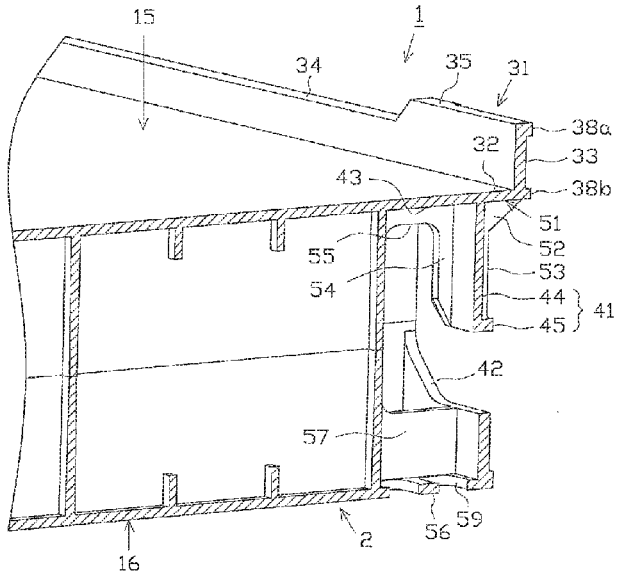
FIG. 11 is a diagram illustrating a perspective view including a cross section of the pallet.

Additionally, as shown in FIG. 11, a rear face rib 54 is provided on a rear face side of the locking element 41 to be protruded toward the inner circumferential side of the pallet 1 from the locking piece 44 and extended from an upper end to a lower end of the locking piece 44. As shown in FIG. 10 and FIG. 11, a rear face side linkage rib 55 is also provided to link an upper portion of the rear face rib 54 with an inner back surface of the locking opening recess 42.

As shown in, for example, FIG. 5, each locking opening recess 42 is configured as one of chambers defined by ribs for reinforcement provided inside of the corner column 2. As shown in, for example, FIGS. 10 to 12, the corner column 2 has a lower wall portion 56 that defines the lower deck surface 16. An upper edge of the opening of the locking opening recess 42 is extended to the lower surface of the upper wall portion 43. A lower edge of the opening is, on the other hand, located above the lower wall portion 56, while providing a sufficient space which the rope passes through to the rear side of the locking element 41, below the locking element 41. Additionally, a lower rib 57 is provided to link a wall portion placed below the opening of the locking opening recess 42 with the inner back surface of the locking opening recess 42, and a back rib 58 is provided to link the lower rib 57 with the rear face side linkage rib 55 (as shown in FIG. 10). This configuration suppresses reduction of the strength of the corner column 2 due to formation of the locking opening recesses 42 or more specifically suppresses reduction of the strength in the peripheries of the locking opening recesses 42 and prevents deformation of the locking elements 41. As shown in, for example, FIG. 9 and FIG. 10, the lower wall portion 56 is provided with drain holes 59 for discharging water entering the locking opening recesses 42.

As described above in detail, according to this embodiment, with regard to the rib pitches of the plurality of full-length ribs 23 continuously extended approximately linearly from one side to the other side of the upper deck surface 15 on the lower surface side of the upper deck 5, the inner rib pitches P1 and P4 on the center side in the width of the pallet 1 in the direction perpendicular to the extending direction of the full-length ribs 23 are made narrower than the outer rib pitches P2 and P5 of the side ends. Providing the full-length ribs 23 extended in the left-right direction of FIG. 5 is highly effective for preventing deformation of the pallet 1, for example, when the forks 9 are inserted into the fork insertion structures 8 from the lower side on the sheet surface to lift up the pallet 1 as shown in FIG. 5. Densely forming the full-length ribs 23 effective for preventing deformation of the pallet 1 but limiting the range of formation as described above effectively enhances the rigidity of the pallet 1 (upper deck 5), while reducing the total number of full-length ribs 23 in the pallet 1. Accordingly this configuration reduces the total weight of the pallet 1 while preventing the respective side parts of the pallet 1 from being bent and deflected downward when the forks 9 are inserted into the fork insertion structures 8 to lift up the pallet 1.

The middle linkage rib pitches P3 and P6 of the plurality of middle linkage ribs 21 arranged to link the middle columns 3 with the center column 4 are made narrower than the inner rib pitches P1 and P4 of the full-length ribs 23 extended parallel to the middle linkage ribs 21. Additionally, the wall thickness of the middle linkage ribs 21 is made greater than the wall thickness of the full-length ribs 23. This configuration prevents deflection of the middle part of the pallet 1 in the state that the pallet 1 is supported only on its peripheral edge (its respective side parts). This configuration more effectively suppresses such deformation of the upper deck 5 that changes the relative positions of the middle column 3 to the center column 4. This configuration also effectively suppresses side toppling of the full-length ribs 23 crossing the middle linkage ribs 21 at the middle positions of the full-length ribs 23.

According to this embodiment, the full-length ribs 23 are configured such that the inner rib pitches P1 and P4 are narrower than the outer rib pitches P2 and P5. This configuration causes the full-length ribs 23 and the middle linkage ribs 21 that are both densely arranged and have the enhanced strength to support each other and to be supported by each other. This configuration also suppresses deformation of the side wall portions of the center column 4 and the middle columns 3 surrounded by the densely arranged full-length ribs 23 and middle linkage ribs 21. Accordingly this further ensures the function and the effect of preventing deflection of the middle part of the pallet 1 and the function and the effect of preventing deflection of the respective side parts of the pallet 1.

According to this embodiment, the height of the support convex 33 in the insertion-corresponding region 34 that is the region of the outer circumferential projection 31 located above the fork insertion structure 8 and the thickness of the lower deck 6 are configured to be an identical length. Accordingly, in the case of stacking the pallets 1, the height of the upper end of the support convex 33 in the insertion-corresponding region 34 of the lower pallet 1 is equal to the height of the upper surface of the lower deck 6 of the upper pallet 1 (as shown in FIG. 7 and FIG. 8). In the state that the pallets 1 are stacked, this configuration prevents the inlet (more specifically, its vertical width) of the fork insertion structure 8 in the upper pallet 1 from being narrowed by the outer circumferential projection 31 (i.e., the support convex 33 in the insertion-corresponding region 34) of the lower pallet 1 when the forks 9 are inserted into the fork insertion structures 8 of the upper pallet 1. As a result, this configuration can improve the workability, for example, when the stacked pallets 1 are sequentially lifted down from the top by using the forklift.

In the case of stacking the pallets 1 by using the forklift, after the upper pallet 1 is placed on the lower pallet 1, the forks 9 are displaced downward to release the support of the lower surface of the upper deck 5 by the forks 9, for the purpose of drawing the forks 9 out of the fork insertion structures 8. This configuration prevents the fork 9 from coming into contact with the outer circumferential projection 31 (i.e., the support convex 33 in the insertion-corresponding region 34) of the lower pallet 1 and damaging the outer circumferential projection 31 in the course of displacing the forks 9 downward.

The outer circumferential projection 31 is also provided in the region (general region 35) other than the region corresponding to the fork insertion structure 8. The height of the support convex 33 in the general region 35 is greater than the height of the support convex 33 in the insertion-corresponding region 34. Even when the height of the support convex 33 in the insertion-corresponding region 34 is reduced not to interfere with the fork insertion operation, this configuration ensures the sufficient height of the support convex 33 in the general region 35. This avoids possible adverse effects on the fork insertion operation due to providing the outer circumferential projection 31. Providing the outer circumferential projection 31 more effectively prevents an article or articles mounted on the upper deck surface 15 from being dropped off and prevents the upper pallet 1 from being dropped off. Such function and effect are especially remarkable in the configuration that the height (thickness) of the pallet 1 is 90 mm and the thickness of the lower deck 6 is accordingly to be reduced like this embodiment.

Additionally, this configuration enhances the rigidity of the outer circumferential projection 31 or more specifically the rigidity of the support convex 33, compared with a configuration that leaves only the support convex 33 in the general region 35 of the outer circumferential projection 31 but omits the support convex 33 in the insertion-corresponding region 34. This configuration also enhances the rigidity of and suppresses deformation of the upper deck 5 (the upper edge of the inlet of the fork insertion structure 8).

The projection reinforcement ribs 36 are formed on the outer surface side of the support convexes 33, with a view to enhancing the rigidity of the outer circumferential projections 31. With regard to the rib pitches of the plurality of vertical ribs 37 that are extended vertically among the projection reinforcement ribs 36 formed corresponding to the insertion-corresponding regions 34, the side rib pitch P9 in the respective side parts of the insertion-corresponding region 34 connecting with adjacent general regions 35 is made narrower than the center rib pitch 10 in the center part of the insertion-corresponding region 34. This configuration enhances the rigidity of the linkage regions of the upper deck 5 with the corner columns 2 and the middle columns 3 (respective ends of the upper edges of the inlets of the fork insertion structures 8). These linkage regions are more likely to be deformed by a downward load or by a torsional force applied to the pallet 1, compared with, for example, the corner columns 2 and the middle columns 3. Enhancing the rigidity of the linkage regions effectively suppresses deformation of the upper deck 5 and thereby deformation of the entire pallet 1.

The projection reinforcement ribs 36 also include the lateral ribs 38 extended in the direction perpendicular to the vertical ribs 37 and are thereby arranged in a grid pattern. This configuration suppresses side toppling deformation of the respective vertical ribs 37 and enhances the linkage of the vertical ribs 37 in the lateral direction. This accordingly suppresses vertically-shifting deformation of the vertical ribs 37 laterally adjacent to each other and distributes a downward load or a load from the inner circumferential side of the pallet 1. Especially the configuration of the lateral ribs 38 that are continuously extended from the insertion-corresponding region 34 to the general region 35 enhances such function and effect. Accordingly this configuration more effectively suppresses deformation such as deflection of the upper edge of the inlet of the fork insertion structure 8 and damage of the support convex 33.

According to this embodiment, the locking elements 41 are provided in the two side faces of the respective corner columns 2 that define the outer circumferential surface of the pallet 1 to lock the rope for holding an article or articles mounted on the pallet 1. The locking element 41 includes the locking piece 44 that is extended downward from the upper wall portion 43 defining the upper edge of the locking opening recess 42 inside of the locking opening recess 42, and the outer edge reinforcement rib 45 that is protruded from the surface of the locking piece 44 on the outer circumferential side of the pallet 1 along the peripheral edge of the locking piece 44. The end of the outer edge reinforcement rib 45 is flush with the side face (outer surface) of the corner column 2. In other words, the locking element 41 is located on the inner circumferential side of the pallet 1 away from the end of the middle lateral rib 38*b* of the projection reinforcement rib 36 (i.e., the edge of the mounting wall 51 consisting of the upper wall portion 43, the extended portion 32 and the middle lateral rib 38*b*, on the outer circumferential side of the pallet 1) protruded outward from the extended portion 32 of the outer circumferential projection 31 that is extended outward from the upper wall portion 43 by a predetermined distance.

In this configuration of the embodiment, the corner column 2 has the locking reinforcement rib 52 that links the surface of the locking element 41 (locking piece 44) on the outer circumferential side of the pallet 1 with the lower surface of the mounting wall 51. At least the side of the mounting wall 51 on the outer circumferential side of the pallet 1, i.e., the outer circumferential projection 31, is located on the outer circumferential side of the locking element 41 in the outer circumferential direction of the pallet 1. This configuration suppresses the locking element 41 from unintentionally coming into contact with another member and being caught or being scraped by another member. The locking element 41 is located on the inner circumferential side of the pallet 1 away from the side of the mounting wall 51 on the outer circumferential side of the pallet 1 by a predetermined distance. The locking reinforcement rib 52 can thus be provided to link the surface of the locking element 41 on the outer circumferential side of the pallet 1 with the lower surface of the mounting wall 51. Providing the locking reinforcement rib 52 enhances the strength of the locking element 41 itself. Accordingly this configuration effectively prevents the locking element 41 from being damaged.

More specifically, in the configuration of this embodiment, the locking piece 44 of the locking element 41 is located on the inner circumferential side of the pallet 1 away from the outer surface of the corner column 2 by a predetermined distance, and the edge of the outer edge reinforcement rib 45 protruded outward from the locking piece 44 is flush with the outer surface of the corner column 2. The configuration that the locking element 41 is not protruded outward from the outer surface of the corner column 2 on which the locking element 41 and the outer edge reinforcement rib 45 are provided further enhances the function and the effect of preventing the locking element 41 from being caught or the like by another member.

Additionally, the locking reinforcement rib 52 is provided at the position corresponding to the center position in the width direction of the locking element 41. This effectively reinforces the locking element 41 while suppressing an increase in number of the locking reinforcement ribs 52. The locking reinforcement rib 52 is extended to the edge of the lower surface of the mounting wall 51 on the outer circumferential side of the pallet 1. This configuration further enhances the function and the effect of the locking reinforcement rib 52 on enhancing the rigidity of the locking element 41. The side of the locking reinforcement rib 52 on the outer circumferential side of the pallet 1 is extended to be inclined upward toward the outer circumferential side of the pallet 1. This configuration enables the locking reinforcement rib 52 to be extended as long as possible toward the outer circumferential side of the pallet 1 while suppressing the locking reinforcement rib 52 from being caught by another member, thus more effectively preventing the base of the locking reinforcement rib 52 from being broken.

The locking reinforcement rib 52 is provided in the upper range of the locking element 41 (i.e., the range of not greater than ⅓ of the total height of the locking element 41 from the connecting portion with the mounting wall 51). This configuration enables the locking reinforcement rib 52 to be extended as long as possible toward the outer circumferential side of the pallet 1 while suppressing the locking reinforcement rib 52 from being caught by another member, thus more effectively preventing the base of the locking reinforcement rib 52 from being broken. Additionally, the projection reinforcement rib 36 is configured to have the shorter outward projection length in the region of the projection reinforcement rib 36 corresponding to the locking opening recess 42. Additionally, regions where the outward projection length of the projection reinforcement rib 36 is not shortened (with no omission of the lower lateral rib 38*c*) are provided on both sides of the region where the outward projection length of the projection reinforcement rib 36 is shortened. In other words, wall portions located on the outer circumferential side of the pallet 1 relative to the edge of the mounting wall 51 on the outer circumferential side of the pallet 1 are provided at the positions on the respective sides of the mounting wall 51. This configuration ensures the effect of suppressing the locking reinforcement rib 52 from coming into contact with another member even when the locking reinforcement rib 52 is extended to the edge of the mounting wall 51 on the outer circumferential side of the pallet 1.

According to this embodiment, the extended reinforcement rib 53 is formed by extending the locking reinforcement rib 52 upward and downward. This configuration enhances the rigidity in the region supporting the locking reinforcement rib 52. More specifically, the extended reinforcement rib 53 is extended to be linked with the outer edge reinforcement rib 45 that is extended in the direction crossing the extended reinforcement rib 53. This configuration suppresses deformation such as side toppling or torsion of the extended reinforcement rib 53. Additionally, the extended reinforcement rib 53 is provided to be flush with the edge of the outer edge reinforcement rib 45 of the locking element 41 on the outer circumferential side of the pallet 1 and with the outer surface of the corner column 2. This configuration reduces the likelihood that the extended reinforcement rib 53 comes into contact with another member.

In the configuration that the outer circumferential projection 31 is provided on the upper deck surface 15 and the locking piece 44 is provided on the inner side of the outer surface of the corner column 2 away from the outer surface by a predetermined distance like this embodiment, there is a relatively wide distance between the rear face of the locking element 41 where the rope is caught and the edge of the mounting wall 51 on the outer circumferential side of the pallet 1 (i.e., the outer surface of the outer circumferential projection 31 or more specifically the edge of the projection reinforcement rib 36). This configuration increases the likelihood that that the locking element 41 receives a force from the rope to be pulled in the outer circumferential direction of the pallet 1. Compared with a configuration that the locking element 41 is mainly pulled upward, this is likely to increase the load applied to the locking element 41. The locking reinforcement rib 52 is provided to link the outer surface of the locking element 41 with the lower surface of the mounting wall 51 as described above. This configuration effectively enhances the strength of the locking element 41 against the pulling force in the outer circumferential direction of the pallet 1 and thereby prevents damage of the locking element 41.

The invention is not limited to the details of the embodiment described above but may be implemented by aspects described below. There are various applications and modifications other than those described below.

Figure 13:
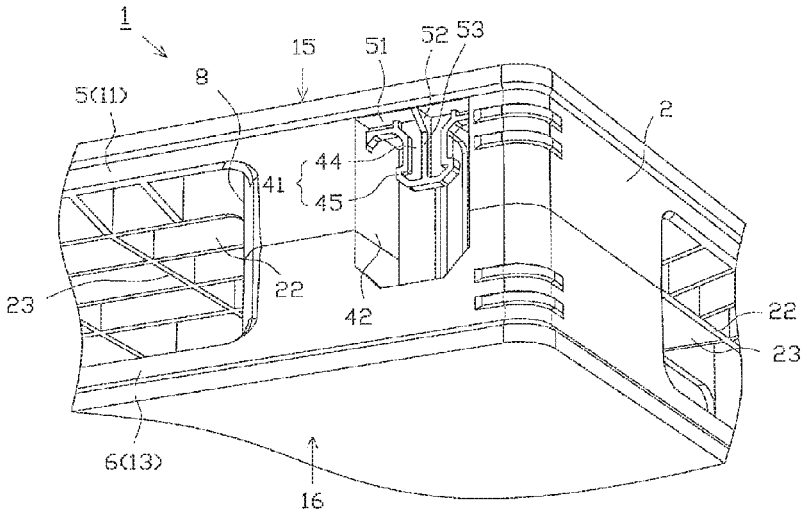
FIG. 13 is a diagram illustrating a perspective view of a modification of the pallet.

(a) The embodiment describes the configuration of the pallet 1 that has the caster openings 14 formed in the lower deck 6 and is transportable by using a handlift. The invention may, however, be applied to a pallet with omission of the caster openings 14 or a two-side pallet that is configured to allow both deck surfaces in place of a single deck surface (upper deck surface 15) to be used as the mounting surface on which an article or articles are mounted. The invention may also be applied to a pallet configured with omission of the locking elements 41, a pallet configured with omission of the outer circumferential projections 31 as shown in FIG. 13 or a pallet configured by welding an upper configuration part 1*a* and a lower configuration part 1*b* formed to have an identical configuration. In the application of the invention to the pallet with omission of the caster openings 14, with regard to the lower deck 6, the inner rib pitch of the full-length ribs 23 on the center side in the width direction of the pallet 1 in the direction perpendicular to the extending direction of the full-length ribs 23 may be made narrower than the outer rib pitch on the outer side in the width direction, and the middle linkage rib pitch may be made narrower than the inner rib pitch. This configuration effectively enhances the rigidity with respect to the lower deck 6. Additionally the invention may be applied to a pallet with omission of the lower deck 6.

(b) According to the above embodiment, among the full-length ribs 23 extended along a predetermined fork insertion structure 8, the full-length ribs 23 located on the center side of the pallet 1 relative to the center in the width direction of the fork insertion structure 8 are configured to have the inner rib pitch P1 or P4. The invention is, however, not limited to this configuration. For example, according to the above embodiment, the full-length ribs 23 are configured to have two different pitches, i.e. the outer rib pitch P1 (P4) and the inner rib pitch P2 (P5). The full-length ribs 23 may, however, be configured to change the rib pitch in three or more stages in such a manner as to gradually narrow the rib pitch from the side end toward the center of the pallet 1 in the width direction of the fork insertion structure 8. Arranging the full-length ribs 23 at the pitches like the above embodiment, however, provides the more significant function and effect of ensuring the effective reinforcement while suppressing an increase in weight of the pallet 1. Tightly packing the regions of the dense rib pitch like the above embodiment forms the regions of the higher rigidity. Efficiently linking such regions forms the stronger framework and provides the pallet 1 having the high resistance to deformation.

According to the above embodiment, the side linkage ribs 22 arranged to link the corner column 2 with the middle column 3 are configured to have the same thickness as that of the middle linkage ribs 21 and are arranged at the same rib pitch as that of the middle linkage ribs 21. The thickness of the side linkage ribs 22 may be made equal to the thickness of the full-length ribs 23, and the rib pitch of the side linkage ribs 22 may be wider than the rib pitch of the middle linkage ribs 21. Such modification further reduces the total weight. The pitches and the thicknesses of the respective ribs may be adequately changeable in design with respect to each pallet.

(c) According to the above embodiment, the height (thickness) of the pallet 1 is 90 mm. The invention is, however, not limited to this configuration but may be applied to a pallet 1 having the height of greater than 90 mm. Any of the thickness of the upper deck 5, the thickness of the lower deck 6 and the vertical width of the fork insertion structure 8 is also not specifically limited but may be adequately changeable in design. The vertical width of the fork insertion structure 8 is, however, preferably not less than 55 mm and is more preferably not less than 60 mm by taking into account the thickness of the forks 9, the workability and the like.

In the application of the invention to a relatively thin pallet 1 having the height of not greater than 100 mm or more specifically a pallet 1 having the thickness of the lower deck 6 of about 10 mm to 15 mm, simply matching the height of the support convex 33 of the outer circumferential projection 31 to the thickness of the lower deck 6 has little function and effect of the outer circumferential projections 31 to prevent an article or articles mounted on the pallet 1 from being dropped off and prevent the pallet 1 from being dropped off. The configuration of the above embodiment that sets the height of the support convex 33 in the insertion-corresponding region 34 of the outer circumferential projection 31 equal to the thickness of the lower deck 6 but sets the height of the support convex 33 in the general region 35 to be greater than the height of the support convex 33 in the insertion-corresponding region 34 further ensures the effect of providing the outer circumferential projections 31 on preventing the articles or like from being dropped off.

According to the above embodiment, the height of the support convex 33 in the genera region 35 and the thickness of the lower deck 6 are configured to be the identical length. The expression "identical length" herein includes "substantially identical length" by taking into account the manufacturing error and the like.

Figure 14:
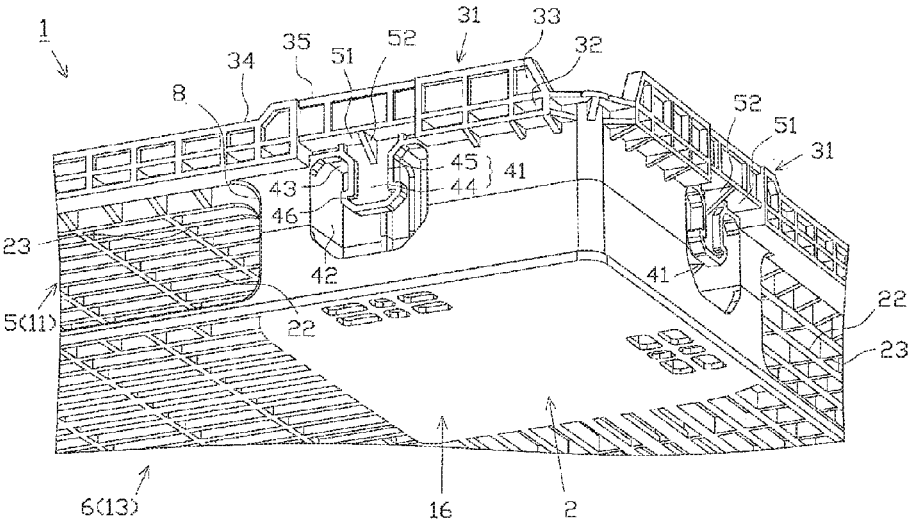
FIG. 14 is a diagram illustrating a perspective view of another modification of the pallet.

(d) In the configuration of the above embodiment, the locking elements 41 are formed in the respective two faces of all the corner columns 2 defining the outer circumferential surface of the pallet 1. The invention is, however, not limited to this configuration. For example, the locking elements 41 may be provided on the middle columns 3. In the configuration of the above embodiment, the locking piece 44 of the locking element 41 is located on the inner circumferential side of the pallet 1 relative to the side face (outer surface) of the corner column 2, and the outer edge reinforcement rib 45 of the locking element 41 is flush with the outer surface of the corner column 2. As shown in FIG. 13, according to a modification, the entire locking element 41 including the outer edge reinforcement rib 45 may be located on the inner circumferential side of the pallet 1 relative to the outer surface of the corner column 2. As shown in FIG. 14, the extended reinforcement rib 53 of the locking element 41 may be omitted.

Additionally, for example, the shape, the range of formation and the number of the locking reinforcement ribs 52 is not limited. In order to effectively reinforce the locking element 41 with the minimum possible amount of the material and reduce the likelihood that the locking element 41 comes into contact with another member, it is, however, desirable that the locking reinforcement rib 52 in a triangular plate-like shape is provided to obliquely connect the upper region of the locking piece 44 with the edge of the mounting wall 51 on the outer circumferential side of the pallet 1 at the center position in the width direction of the locking piece 44 like the above embodiment. The side of the locking reinforcement rib 52 on the outer circumferential side of the pallet 1 may be linear or may be curved.

The rope locked by the locking element 41 may be in any form that enables an article or articles mounted on the pallet 1 to be held, such as string form or a chain form. The rope may be an extendable form such as rubber band.

(e) According to the above embodiment, the pallet 1 is made of polypropylene. According to a modification, the pallet 1 may be made of another resin material such as polyethylene, PET or polyamide.

What is claimed is:

1. A pallet in an approximately rectangular shape in a plan view, the pallet comprising:

four corner columns that are provided at four corners of the pallet;

four middle columns, each being provided in a middle between each pair of the corner columns arranged along a side of the pallet;

a center column provided at a center of the pallet;

an upper deck configured to link upper ends of the corner columns, the middle columns, and the center column, such that upper surfaces of the corner columns, the middle columns, the center column, and the upper deck form an upper deck surface on which an article is mountable; and a lower deck configured to link lower ends of the corner columns, the middle columns, and the center column, such that lower surfaces of the corner columns, the middle columns, the center column, and the lower deck form a lower deck surface which is grounded to an installation surface; and fork insertion structures defined by a lower surface of the upper deck, an upper surface of the lower deck, and side faces of the corner columns, the middle columns, and the center columns, the fork insertion structures having a width defined by a distance between the side faces opposing to each other and being configured to receive forks of fork-equipped lift apparatus which are inserted thereto from four sides of the pallet, the four sides of the pallet constituting an outer circumferential surface of the pallet, wherein the lower deck has a thickness which is smaller than a thickness of the upper deck, wherein a height of the pallet which is a distance between the upper surface of the upper deck and the lower surface of the lower deck is equal to or smaller than 100 mm, wherein the pallet further comprises outer circumferential projections formed along a peripheral edge of the upper deck surface, the outer circumferential projections including:

an extended portion extending outward from the peripheral edge of the upper deck surface; and a support portion protruding upward from the extended portion so as to substantially surround the entire peripheral edge of the upper deck surface, wherein the support portion includes a first part corresponding above each of the fork insertion structures, and a second part other than the first part, the first part having a first height and the second part having a second height greater than the first height, the first part having the same first height over the entire width of the corresponding fork insertion structure, the first height being equal to the thickness of the lower deck.

2. The pallet according to claim 1, further comprising:

reinforcement ribs formed on an outer side of the support portion, the reinforcement ribs including:

a plurality of vertical ribs extending vertically and formed in the insertion-corresponding region, the plurality of vertical ribs having a side rib pitch in respective side parts of the insertion-corresponding region adjacent to the general region, and a center rib pitch in a center part between the side parts, the side rib pitch being narrower than the center rib pitch.

3. The pallet according to claim 2, wherein the reinforcement ribs further include a plurality of lateral ribs extended in a direction so as to cross the vertical ribs, the plurality of vertical ribs and the plurality of lateral ribs forming a grid pattern.

4. The pallet according to claim 1, wherein when the pallet is vertically stacked on a second pallet having an identical structure therewith, an upper end of a first part of a support portion of the second pallet aligns with the upper surface of the lower deck in the fork insertion structures of the pallet stacked thereon over the entire width of the corresponding fork insertion structure.

* * * * *